US005550342A

United States Patent [19]

Danek et al.

[11] Patent Number: 5,550,342

[45] Date of Patent: Aug. 27, 1996

[54] METHOD AND APPARATUS FOR AN ELECTRICAL SWITCH ASSEMBLY

[75] Inventors: Daniel J. Danek, Berwyn; Harry N. Etters, Jr., Downers Grove; Earl J. Genz, Des Plaines; Brigg A. Johnston, Oak Park; Iran R. Littman, Wheaton; John N. Long, Morton Grove; Anthony W. Meadors, Elmhurst; Nicholas J. Mercadante, Lisle; Mario M. Orrico, Chicago; Stephan H. Schramme, Schaumburg; Charles J. Shedore, Elmhurst, all of Ill.

[73] Assignee: Illinois Tool Works Inc., Glenview, Ill.

[21] Appl. No.: 274,479

[22] Filed: Jul. 13, 1994

[51] Int. Cl.[6] ..... H01H 5/06

[52] U.S. Cl. ..... 200/448; 200/303

[58] Field of Search ..... 200/318.1, 448, 200/318.2, 42.01, 43.18, 43.22, 51.05, 51.06, 321, 345, 43.13, 303

[56] References Cited

U.S. PATENT DOCUMENTS 2,884,503 5/1959 Connelly ..... 200/448

4,096,368 6/1978 Grebner ..... 200/314

4,447,685 5/1984 Chashi et al. ..... 200/314

*Primary Examiner*—Renne S. Luebke

*Attorney, Agent, or Firm*—Dvorak and Traub

[57] ABSTRACT

A method and apparatus for an electrical switch assembly generally comprising a snap-action electrical switch disposed in a module frame assembly and connected to electrical contact pins for mating with a contact pin connector. A switch module assembly is connected to the module frame assembly and includes a switch actuator assembly for actuating the snap-action electrical switch. The switch actuator includes a latch spring guide that may be configured for either "alternate" or "momentary" actuation of the snap-action electrical switch and emits audio and tactile switch status indicators perceptible to an operator. The module frame assembly and switch module assembly are releasably connectable to and form an integral unit with a cap base assembly having a cap module with a low power LED illuminatable display visible under extreme ambient lighting conditions for indicating switch status. The integral unit is interlockably receivable in a switch connector module that may include an electrical contact pin socket and is mountable in a bracket.

14 Claims, 7 Drawing Sheets

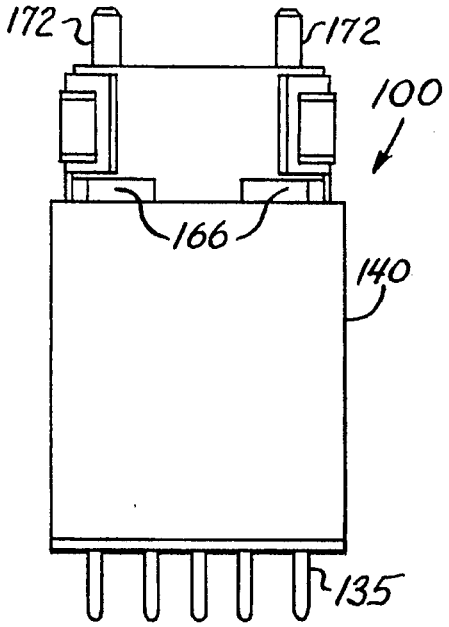
FIG. 3a
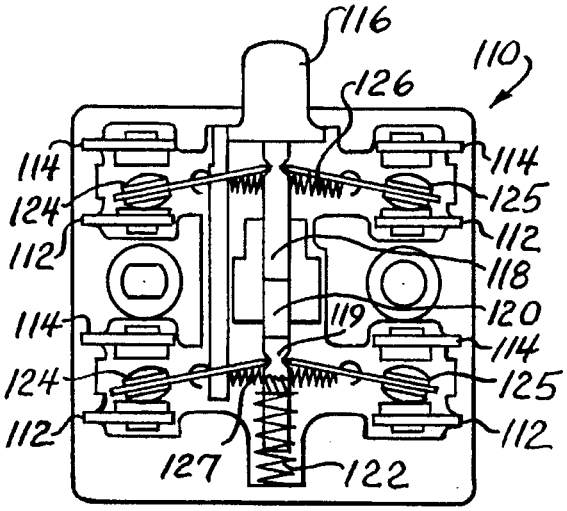
FIG. 3b
FIG. 3d
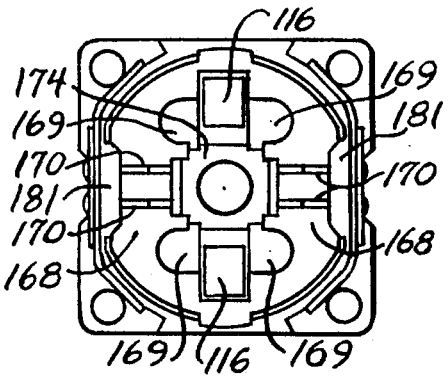
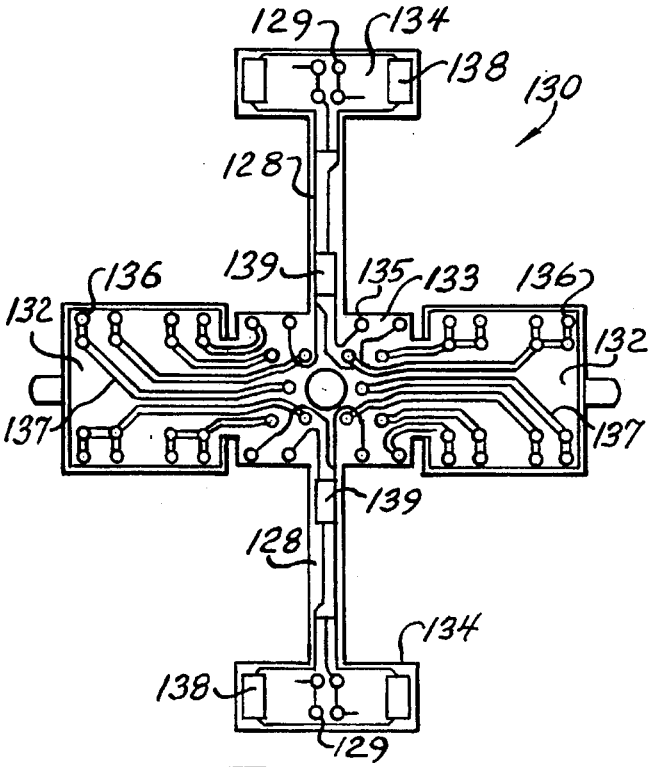
FIG. 3c
FIG. 3e
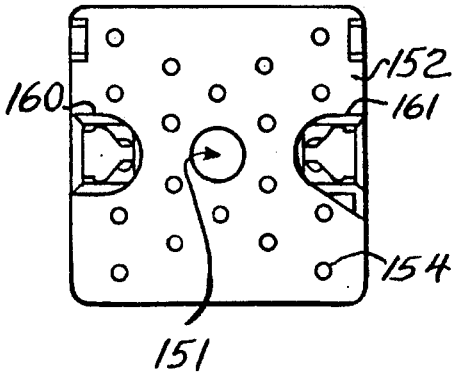

FIG. 4b
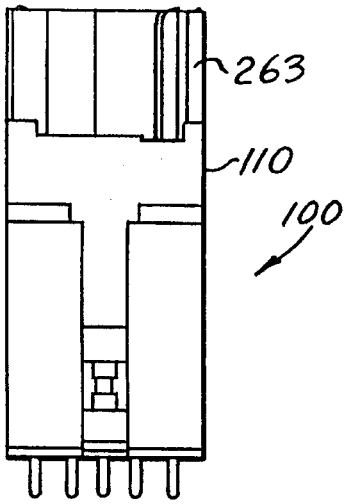
FIG. 4d
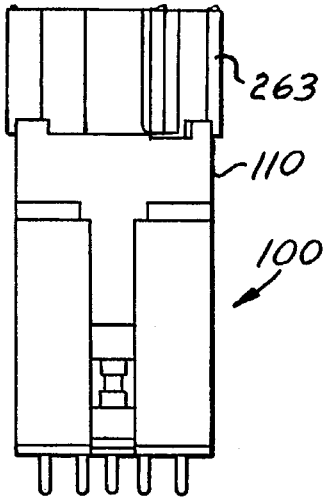
FIG. 4c
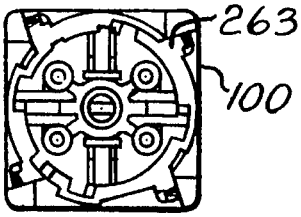
FIG. 4e
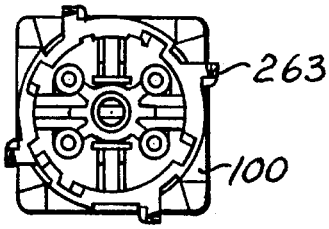
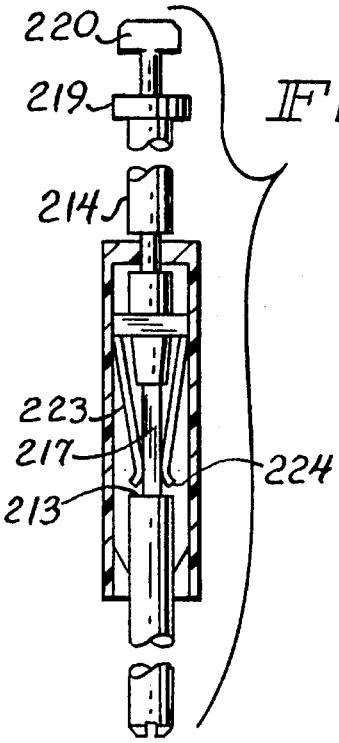
FIG. 4f
FIG. 4g
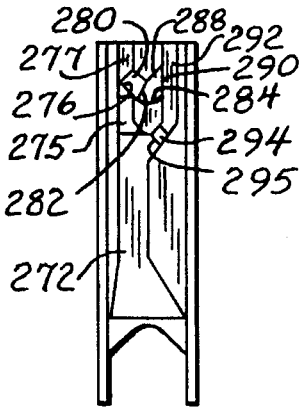
FIG. 4h
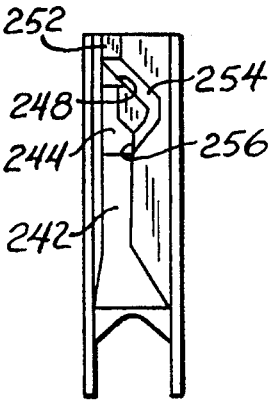

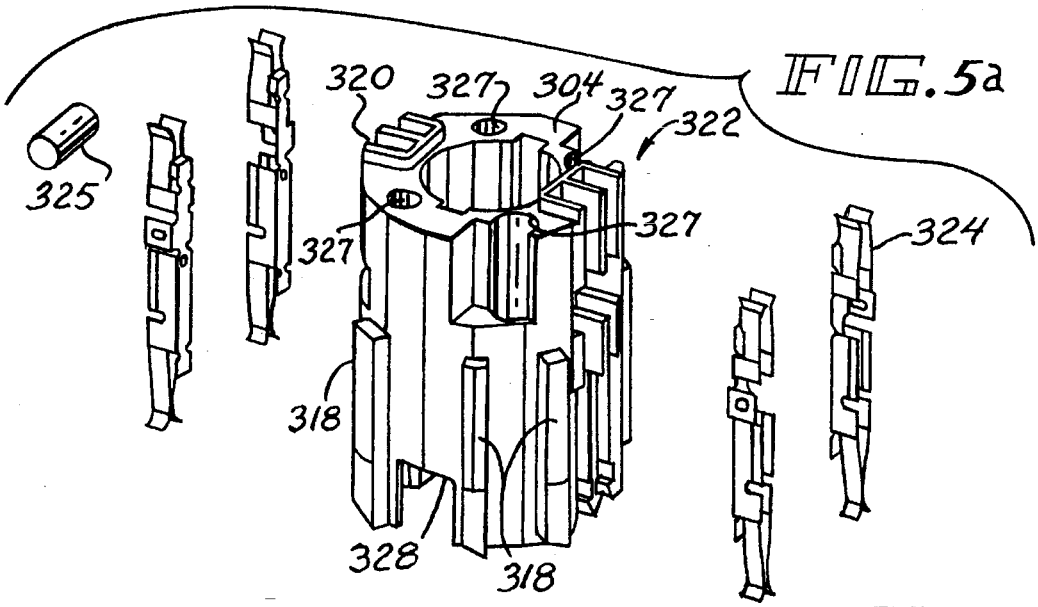
FIG. 5a
FIG. 5d
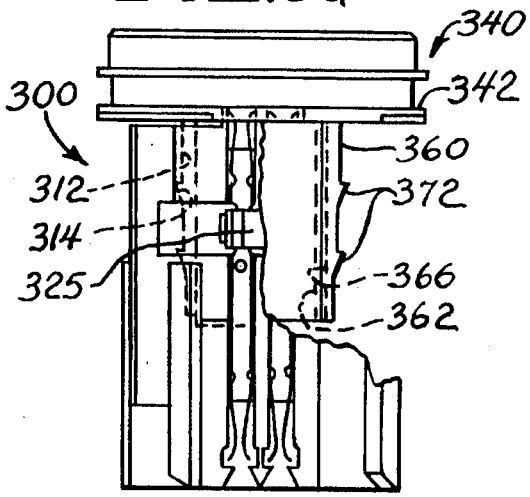
FIG. 5b
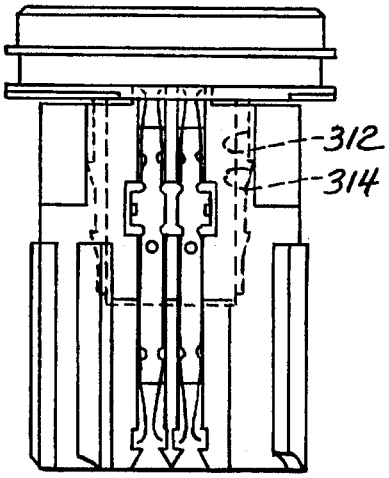
FIG. 5c
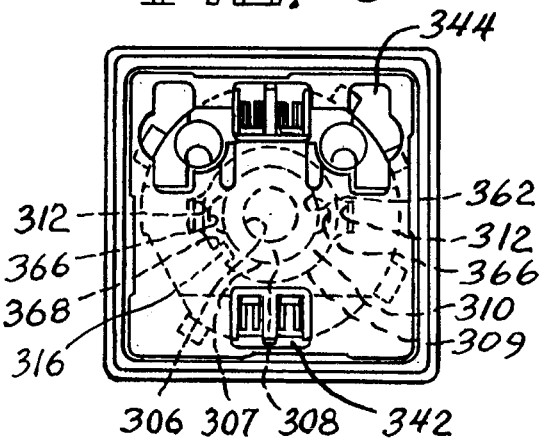
FIG. 5e
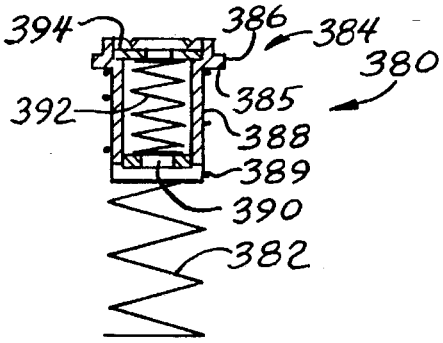

METHOD AND APPARATUS FOR AN ELECTRICAL SWITCH ASSEMBLY

FIELD OF THE INVENTION

The present invention generally relates to a method and apparatus for an electrical switch assembly and more specifically to a novel electrical switch assembly having a basic electrical switch element disposed in a frame assembly and connected to contact pins matable with a contact pin connector. The novel switch assembly may be configured for "alternate" or "momentary" operation of the electrical switch element, and includes an illuminatable switch status display indicator visible under extreme ambient lighting conditions as well as audible and tactile switch status indicators perceptible to an operator.

BACKGROUND OF THE INVENTION

Electrical switches are often used in applications where it is necessary to install and replace the switch in an electrical circuit without disassembling the switch or circuit, and these tasks may be performed under extreme time constraints. It has therefore been suggested to dispose an electrical switch in a housing having electrical contact pins connected to the switch and extended from the housing to form a modular switch assembly that may be readily connected to an electrical pin connector of an electrical circuit. Electrical switch assemblies connected or plugged into a contact pin connector are generally mounted in a panel, and the electrical connection is made by frictional contact between the electrical contact pins and the electrical contact pin connector, which may separate when subject to operational and environmental conditions.

Many electrical switch assemblies are used in applications where the status of the switch itself, or a function controlled by the switch, is not readily apparent to a switch operator, as may be the case in switch assemblies used, for example, in submersible and aerospace technologies. To overcome these problems, it has been suggested to include an electrical or mechanical display on the switch or switch assembly to indicate switch status, that is, to indicate whether the switch is opened or closed, or to indicate status of a remote activity.

Electrical switch assemblies are also used in environments subject to varying and extreme ambient lighting conditions, as may be the case in an aircraft cockpit instrument panel, where brilliant sunlight may be transmitted through the cockpit windows. These conditions may inhibit the pilot or switch operator's ability to ascertain the status of the switch by obscuring visibility of the switch or the switch status display indicator. In the past, some switch assemblies have employed bright incandescent light bulb illuminated displays to indicate switch status under extreme ambient lighting conditions. Incandescent light bulbs however require substantial power to operate, and generate a substantial amount of heat that must be dissipated by the switch assembly or by the panel in which the switch assembly is mounted. Additionally, many applications have a limited capacity to provide power for switch status display indicator purposes, and a limited capacity to dissipate heat. For example, in aircraft instrument panels, switch assemblies are often disposed adjacent other heat sensitive instruments that may be adversely affected by heat generated by a switch assembly. Further, some illuminated displays form a part of the switch actuator which may become very hot and uncomfortable for a switch operator to touch. This is particularly true of momentary type switch assemblies in which the switch operator is required to depress and maintain pressure on a switch actuator to operate the switch. Additionally, despite the use of brightly illuminated switch status display indicators, there may still be situations where the switch operator is unable to ascertain the switch status by relying on a mere visual observation of the switch or the switch status display indicator. There is therefore a need for an advancement in the art of electrical switch assemblies with switch status indicators.

It is an object of the present invention to provide a novel electrical switch assembly.

It is also an object of the present invention to provide a novel electrical switch assembly that may be removably installed or connected to an electric circuit without special expertise.

It is another object of the present invention to provide a novel electrical switch assembly that may be connected to a contact pin connector and lockably secured thereto.

It is another object of the present invention to provide a novel electrical switch assembly with a low power, illuminatable switch status display indicator that is visible under extreme ambient lighting conditions.

It is a further object of the present invention to provide a novel electrical switch assembly that efficiently dissipates heat generated by an illuminatable switch status display indicator.

It is still a further object of the present invention to provide a novel electrical switch assembly with audible and tactile switch status indicators perceptible to a switch operator.

Accordingly, the present invention is directed toward a method and apparatus for an electrical switch assembly generally comprising a snap-action electrical switch disposed in a module frame assembly and connected to electrical contact pins for mating with a contact pin, or socket, connector. A switch module assembly having a ribbed collar is pivotally connected to the module frame assembly and includes a switch actuator assembly disposed on a shaft movable in and out of the module frame assembly for actuating the snap-action electrical switch. The switch actuator assembly includes a latch spring guide interactable with a latch spring hook disposed in the module frame assembly to control the actuation Of the snap-action electrical switch. The latch spring guide may be configured for either "alternate" or "momentary" actuation of the snap-action electrical switch and emits audible and tactile switch status indicators perceptible to an operator. The module frame assembly and switch module assembly are releasably connectable to and form an integral unit with a cap base assembly having a cap module with a low power LED illuminated display indicator visible under extreme ambient lighting conditions. The integral unit is receivable in a switch connector module, or housing, that may include an electrical contact pin socket and is mountable in a bracket. The ribbed collar of the switch module assembly is extendable into and engagable with corresponding slots in sidewalls of the switch connector module to lock the integral unit therein upon pivoting the ribbed collar relative to the module frame assembly.

These and other objects, features and advantages of the present invention will become apparent upon consideration of the following Detailed Description of the Invention with the accompanying drawings.

BRIEF DESCRIPTION OF THE DRAWINGS

FIG. 3*a* is a side view of a module frame assembly of the present invention.

FIG. 3*b* is a sectional view of a snap-action type electrical switch.

FIG. 3*c* is top view of a flattened flexible circuit board connected to a pair of snap-action electrical switches.

FIG. 3*d* is a top view of FIG. 3*a*.

FIG. 3*e* is a bottom view of FIG. 3*a*.

FIG. 4*b* is a side view of FIG. 4*a* showing ribs of the switch module assembly in a recessed position relative to the module frame assembly.

FIG. 4*c* is a top view of FIG. 4*a* showing the switch module assembly in the recessed position.

FIG. 4*d* is a side view of FIG. 4*a* showing the ribs of the switch module assembly in an extended position relative to the module frame assembly.

FIG. 4*e* is a top view of FIG. 4*a* showing the switch module assembly in the extended position.

FIG. 4*f* is a partial sectional view of a snap-action switch actuator assembly of the present invention.

FIG. 4*g* is a front view of a first latch spring guide of the present invention.

FIG. 4*h* is a front view of a second latch spring guide of the present invention.

FIG. 5*a* is a perspective view of a cap bottom assembly of the present invention.

FIG. 5*b* is a side view of a cap base and cap bottom assembly of the present invention.

FIG. 5*c* is a top view of the cap base assembly of FIG. 5*b*.

FIG. 5*d* is a side view of FIG. 5*a* revealing a portion of the cap base disposed in the cap bottom.

FIG. 5*e* is a partial sectional view of a caplock connector of the present invention.

DETAILED DESCRIPTION OF THE INVENTION

Figure 1:
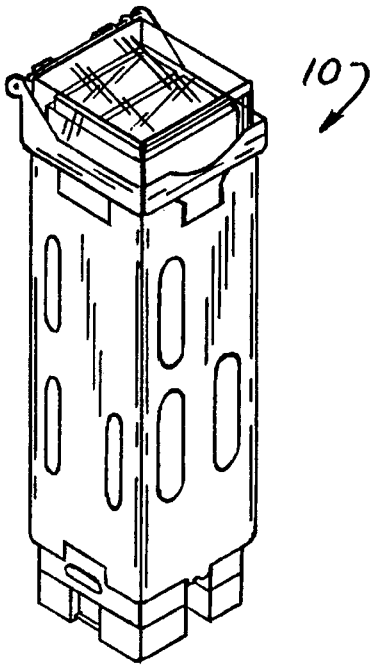
FIG. 1 is a perspective view of a switch according to the present invention.
Figure 2:
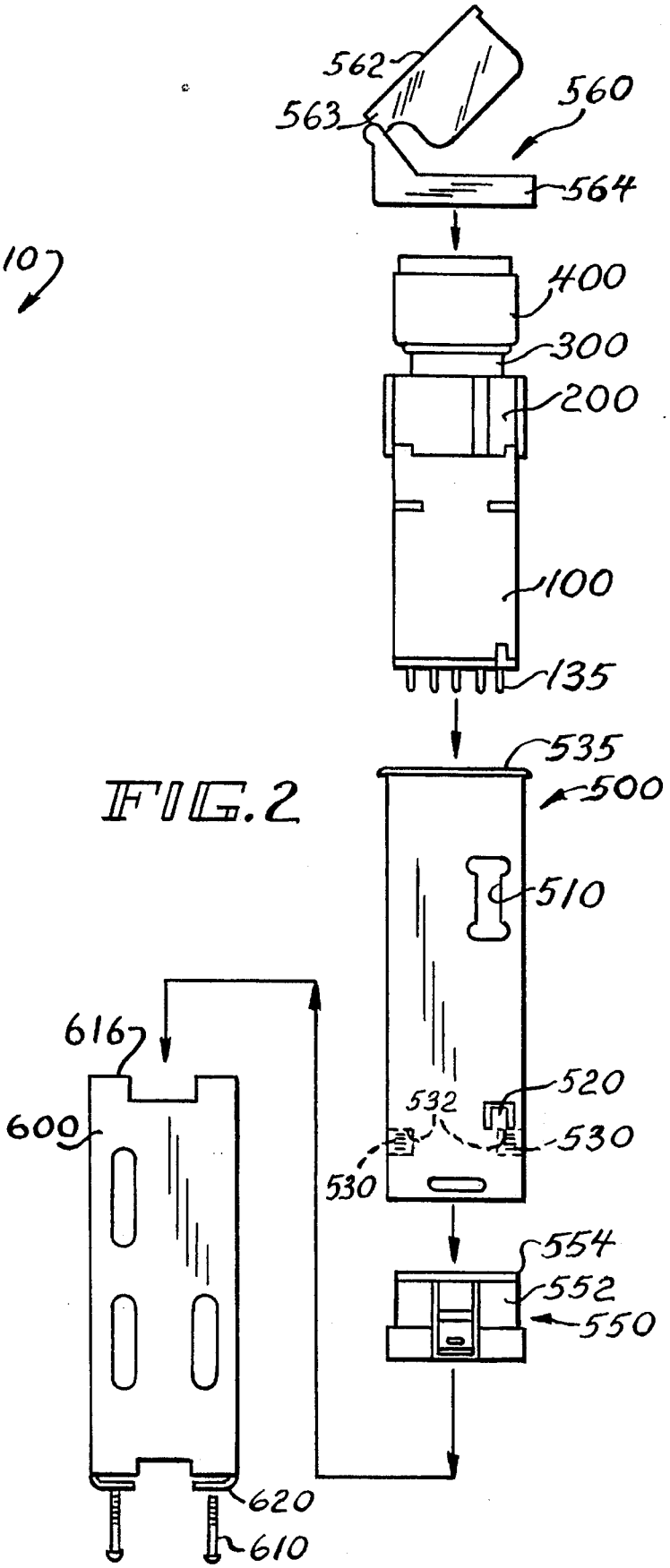
FIG. 2 is an exploded side view of the switch of FIG. 1.

FIG. 1 is a perspective view of a switch 10 of the present invention and FIG. 2 is an exploded side view of FIG. 1. The switch 10 generally comprises a module frame assembly 100 for receiving a basic electrical switch element and is pivotally connected to a switch module assembly 200 for actuating the basic electrical switch element and is releasably connectable to a cap base assembly 300 having a cap module 400 with an illuminatable display for indicating switch status, tile combination of which forms an integral unit that is interlockably receivable in a switch connector module 500, or housing, electrically connectable to a contact pin connector 550, the combination of which is mountable in a bracket 600. In one embodiment, the switch connector module 500 is comprised of a lightweight metal, for example, aluminum, having a scratch and corrosion resistant surface coating.

FIG. 3*a* is a side view of the module frame assembly 100 generally comprising a module frame 140 which houses the basic electrical switch element of the switch 10 comprised of two snap-action type electrical switches 110, manufactured by ITW Switches™. FIG. 3*b* is a sectional view of a snap-action type electrical switch 110 generally comprising two pair of normally closed electrical contacts 112 and two pair of normally open electrical contacts 114. In the discussion of the present embodiment, the switch 110 of FIG. 3*b* is considered to be in an "off" position, although in other embodiments the switch 110 may be considered to be in an "on" position depending on the intended function of the switch. Switches having a different number of electrical contacts may also be used depending on the number of contacts required for the particular electrical circuit application. Using the above convention, the switch 110 is turned "on" when the normally Open contacts are closed and the normally closed contacts are opened, which occurs only while pressure is applied to a switch actuator 116 which moves a conducting ram having two conductors 118 and 119 separated by an insulator 120 against the action of a bias spring 122 to move electrical conducting contacts 124 and 125 against the action of bias springs 126 and 127. The two snap-action switches 110 are interconnected by a flexible electrical circuit board assembly 130 shown in FIG. 3*c* in a flattened configuration for ease of understanding. The flexible circuit board 130 may be comprised of a flexible dielectric material having two snap-action switch mounting areas 132 and two electrical component mounting areas 134 having electrical contacts 129 each interconnected by an arm 128 to an electrical contact pin mounting area 133 having a plurality of electrical contact pins 135. The switch mounting areas 132 include a plurality of electrical contacts 136 which are electrically connected to the corresponding electrical contacts 112 and 114 of the snap-action switches 110. Flexible circuit board traces 137 interconnect the electrical contacts 136 to the contact pins 135 and electrical contacts 129 to form an electrical circuit in which the snap-action switches 110 control electrical circuitry connected to the electrical contacts 129, further discussed below, and outside electrical circuitry connected to the contact pins 135. In one embodiment, resistors 138, fuses 139 and other electrical components may be mounted on the flexible circuit board 130 and incorporated in the electrical circuit by the traces 137.

Figure 4A:
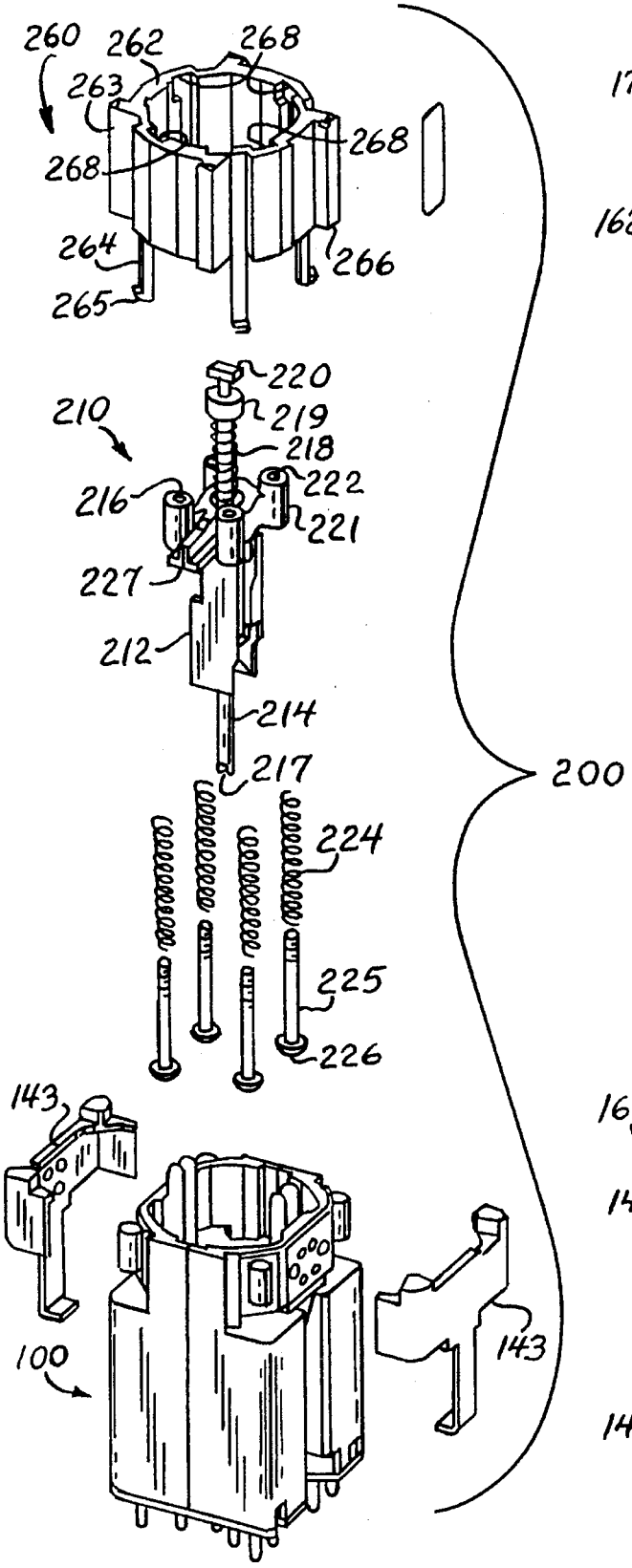
FIG. 4*a* is an exploded perspective view of a switch module assembly and the module frame assembly of the present invention.
Figure 3G:
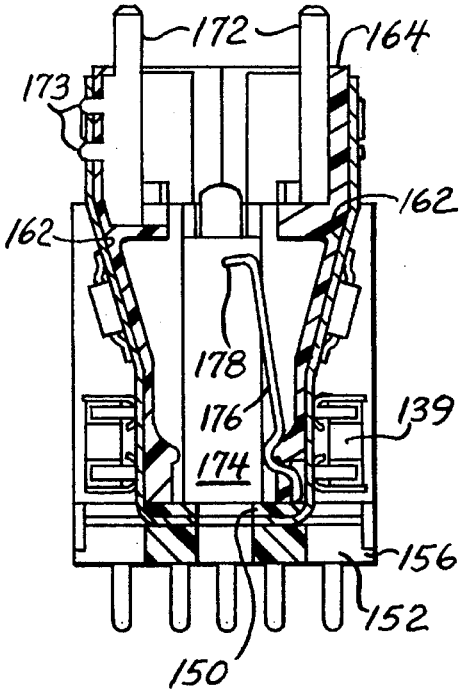
FIG. 3*g* is a sectional view of FIG. 3*a*.
Figure 3F:
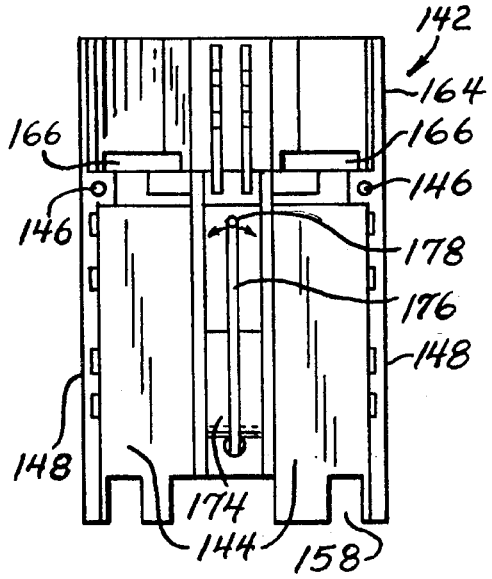
FIG. 3*f* is a side view of a mating frame member of the module frame assembly of the present invention.

FIGS. 3*d* and 3*e* are top and bottom views respectively of the module frame assembly 100, and FIG. 3*f* is a side view of an inner surface of one of two symmetric frame members 142 which comprise the module frame 140. Each frame member 142 includes two cavities 144 for receiving a portion of the snap-action switches 110, mating tabs 146 to properly align the frame members 142 in mating relationship, and a series of nubs 148 which may be ultrasonically welded to form a gapless connection, adhesively binding the mating frame members 142. FIG. 3*g* shows a backup plate 150 disposed on a backside of the electrical contact pin area 133 of the flexible circuit board 130 which is folded to configure the snap-action switches 110 in a parallel arrangement so that they may be inserted into the cavities 144 of the frame members 142. FIG. 3*e* shows a stiffener plate 152 epoxied to the module frame 140 and having a central hole 151 and plurality of electrical contact pin holes 154 through which the electrical contact pins 135 extend. The stiffener plate 152 also includes one or more tabs 156 which mate with corresponding recesses 158 of the module frame 140 to insure proper alignment and affixation thereto, and opposing asymmetric recesses 160 and 161 to ensure proper insertion of the module frame 140 into the switch connector module 500 as discussed below. FIG. 3*g* shows opposing channels having a bottom portion 162 extending along opposing outer sides of the module frame 140 to which the arms 128 or the flexible circuit board 130 are secured with an adhesive. The fuses 139 or other components mounted on the arms 128 are readily accessible may therefore be easily replaced. FIGS. 3*f* and 3*g* show a substantially annular collar 164 forming an upper end of the module frame 140 to which component mounting areas 134 of the flexible circuit board 130 are secured by an adhesive. FIG. 4*a* shows the component mounting areas 134 and arms 128 of the flexible circuit board mounted on the collar 164 and channels of the module frame 140 and protected by a cover 143 disposed on each side of the module frame 140. In one embodiment, the cover 143 includes a section that extends over and protects the fuse 139 but is removable to provide ready access thereto. In another embodiment, the fuses 139 are protected by an insulating Mylar sheath 143*a* retained between the stiffener plate 152 and the module frame 140, wherein flexible wing portions of the sheath are disposed over the fuses to provide insulation without obstructing ready access to the fuses. The collar 164 includes four symmetrically disposed slots 166 which extend through a base portion thereof and opposing shelves 168 which form a partial interface between the collar 164 and cavities 144 permitting at least the switch actuators 116 of the switches 110 to extend above the shelves 168. FIGS. 3*a*, 3*d* and 3*g* show the two shelves 168 each having a pair of recesses 169 and a pair of channels 170 which also extend up a protruding ridge 181 along an inner circumference of the collar 164 for receiving and supporting a pair of electrical contacts 172 which extend above the collar 164 and also comprise tabs 173 which extend through the collar 164 to electrically connect to the electrical contacts 129 on the electrical component mounting area 134 of the flexible circuit board 130. FIGS. 3*d*, 3*g* and 3*f* show an inner channel 174 separating the cavities 144 and extending through the module frame 140. One frame member 142 includes a metal latch spring 176 with an end hook 178 disposed in the inner channel 174 as further discussed below.

FIG. 4*a* is an exploded perspective view of the switch module assembly 200 generally comprising a snap-action switch actuator assembly 210 disposable and retainable in the module frame assembly 100 by a locking collar assembly 260. The switch actuator assembly 210 comprises a latch spring guide 212 rotatably disposed about a shaft 214 both of which are slidably disposable in the inner channel 174 of the module frame 140. The shaft 214 includes a head 219 with a locking blade 220 at one end and a screw driver slot 217 at an opposing end, and is preferably comprised of a corrosion resistant material such as stainless steel or a Teflon coated metal. FIG. 4*f* shows a spring clip 223 squared section 217 of the shaft 214 which permits the shaft 214 to rotate in 90 degree increments relative to the latch spring guide 212. An edge 213 on the shaft 214 abuts an end 224 of the clip 223 to prevent the shaft 214 from moving along an axial direction relative to the guide 212. A frame 216 is disposed about the shaft 214 and is biased against an end of the latch spring guide 212 by a spring 218 disposed between the head 219 of the shaft 214 and the frame 216. The frame 216 includes four return spring retaining members 221 for receiving corresponding return springs 234 disposed about corresponding guide pins 225 each having at one end a head 226 which is seated in one of the corresponding recesses 169 on the opposing shelves 168 of the module frame 140. An opposing end of the guide pins 225 is extendable through a bore 222 in the spring retaining members 221. The frame 216 also includes opposing arms 227 that extend over the snap-action switch actuators 116 and actuate the snap-action switches 110 as further discussed below. The snap-action switch actuator assembly 210 is retained in the module frame assembly 100 by the locking collar assembly 260 which comprises a collar 262 having four ribs 263 extending tangentially from the collar 262 and four legs 264 extending parallel to an axis of the collar 262 with feet 265 extending radially from ends of the legs 264. The legs 264 are disposed along the inner circumference of the collar 164 and the feet 265 extend radially through the slots 166 of the collar 164 to secure the collar 262 to the collar 164 of the module frame 140. In one embodiment, the locking collar assembly 260 is rotatable through an angle of approximately 22 degrees relative to the collar 164 of the frame module 140 which rotation is limited by displacement of the feet 265 within the slots 166. The ribs 263 of the locking collar assembly 260 includes tabs 266 that engage an upper surface of the collar 164 to provide a detent feel at approximately the 0 and 22 degree positions when the locking collar 260 is rotated relative to the collar 164. FIG. 4*b* is a side view and FIG. 4*c* is a top view of the switch module assembly 200 showing the ribs 263 of the locking collar 260 in a recessed position relative to the module frame assembly 100 which orientation permits the module frame assembly 100 and the switch module assembly 200 to be slidably disposed as a unit in the switch connector module 500. FIG. 4*d* is a side view and FIG. 4*e* is a top view of the switch module assembly 200 showing the ribs 263 of the locking collar 260 in a locking position relative to the module frame assembly 200 Which orientation locks the switch module assembly 200 to the switch connector module 500.

FIG. 4*g* is a side view of the latch spring guide 212 illustrating a track or channel 270 for receiving and guiding the hook 178 of the latch spring 176. In one embodiment, the channel 270 is configured for an "alternate" on and off switching operation in which the snap-action switch actuators 116 are first depressed and then latched to turn and maintain the switches 110 in the "on" position. A second, subsequent depression of the switch actuator 210 will turn the snap-action switch 110 to the "off" position. More specifically, as the snap-action switch actuator assembly 210 is first depressed against the bias of return springs 234 and spring 218, the shaft 214 and latch spring guide 212 move into the inner channel 174 of the module frame 140 guiding the hook 178 of the latch spring 176 along a first channel portion 272 of the latch spring guide 212, and moving the opposing arms 227 of the frame 216 toward the snap-action switch actuators 116 and actuating the snap-action switch actuators 116 thereby turning the snap-action switches 110 to the "on" position. In one embodiment, any snapping sound or vibration that may be generated when the switches 110 are turned "on" is masked by the structure of the switch 10 and rendered substantially imperceptible to an operator of the switch 10. The snap-action switches 110 however will not be latched in the "on" position rafters the snap-action switch actuator assembly 210 is further depressed against the bias of return springs 234 and spring 218 wherein the shaft 214 and latch spring guide 212 move still further into the inner channel 174 of the module frame 140 guiding the hook 178 up a ramp 275, over an edge 276 and up into a first channel 277 of a fork. As the hook 178 of the latch spring 176 drops over the edge 276, an audible snapping sound and tactile vibrations are emitted indicating to the operator that the switch has been latched in the "on" position. Removal of the first depressing action on the snap-action switch actuator assembly 210 causes the shaft 214 and the latch spring guide 212 to begin to withdraw from the inner channel 174 of the module frame 140 guiding the hook 178 up a ramp 280, over an edge 282 and into a seat or saddle 284 of the fork. The hook 178 engages and retains the latch spring guide 212 and the shaft 214 against the bias of springs 234 and spring 218 so that the opposing arms 227 continue to depress the snap-action switch actuators 116 and maintain or latch the switches 110 in the "on" position. As the snap-action switch actuator assembly 210 now latched in the "on" position is subsequently depressed against the bias of springs 234 and spring 218, the shaft 214 and the latch spring guide 212 again move further into the inner channel 174 of the module 140 guiding the hook 178 of the latch spring 176 up a ramp 288, over an edge 290 in a second channel 292. Edge 276 prevents the hook 178 from moving back into the first channel 277. Further depression of the snap-action switch actuator assembly 210 is ultimately restrained by the compression of spring 218 between the shaft head 219 and the frame 216 held stationary by the depressed snap-action switch actuators 116 as the shaft 214 slides through the frame 216. Removal of the subsequent depressing action on the snap-action switch actuator assembly 210 causes the shaft 214 and latch spring guide 212 to begin to withdraw from the inner channel 174 of the module frame 140 guiding the hook 178 down channel 292, up a ramp 294 and over an edge 295 and back into the channel 272 of the latch spring guide 212, moving the opposing arms 227 of the frame 216 away from and de-actuating the snap-action switch actuators 116 thereby turning the snap-action switches to the "off" position. The latch spring guide 212 is comprised of a durable material resistant to wear by the hook 178 of the latch spring 176.

FIG. **4*h* is a side view of an alternative embodiment of the latch spring guide 212 illustrating a channel 240 configured for a "momentary" switching operation in which the snap-action switch actuators 116 are depressed to turn the snap-action switches 110 to the "on" position. The snap-action switch actuators 116 are not latched as in the "alternate" on and off switching operation discussed above. More specifically, as the snap-action switch actuator assembly 210 is depressed against the bias of return springs 234 and spring 218, the shaft 214 and latch spring guide 212 move into the inner channel 174 of the module frame 140 guiding the hook 178 of the latch spring 176 along a first channel portion 242 of the latch spring guide 212, and moving the opposing arms 227 of the frame 216 toward the snap-action switch actuators 116 actuates the snap action switch actuators 116 thereby turning the snap-action switches 110 to the "on" position. Again, any snapping sound or vibration that may be generated when the switches 110 are turned "on" is masked by the structure of the switch 10 and rendered imperceptible to the operator of the switch 10. Further depression of the snap-action switch actuator assembly 210 continues to move the shaft 214 and the latch spring guide 212 into the inner channel 174 of the module frame 140 guiding the hook 178 along the first channel 242, up a ramp 244, over an edge 248 and up into a channel 252. As the hook 178 of the latch spring 176 drops over the edge 248, an audible snapping sound and tactile perception are emitted, indicating to the operator that the switch has been turn to the "on" position. Further depression of the snap-action switch actuator assembly 210 is ultimately restrained by the compression of spring 218 between the shaft head 219 and the frame 216 held stationary by the depressed snap-action switch actuators 116 as the shaft 214 slides through the frame 216. Removal of the depressing action on the snap-action switch actuator assembly 210 causes the shaft 214 and the latch spring guide 212 to begin to withdraw from the inner channel 174 of the module frame 140 guiding the hook 178 up a ramp 254, over an edge 256, and back into the channel 242 of the latch spring guide 212, moving the opposing arms 227 of the frame 216 away from and de-actuating the snap-action switch actuators 116** thereby turning the snap-action switches to the "off" position.

FIG. **5*a* is a perspective view of a cap bottom 302 of the cap base assembly 300. FIGS. 5*b*, 5*c*, 5*d* and 5*e* show the cap bottom 302 securely connectable to a cap base 340 having a caplock connector 380 assembly interposed therebetween. The cap bottom 302 comprises a substantially cylindrical body 304 having a central bore 306 extending therethrough, a first counter-bore 307 extending partially into the central bore 306 to form a first annular edge 308 and a second, larger counter-bore 309 extending partially into the first counter-bore 307 to form a second annular edge 310. Opposing channels 312 with tab receiving depressions 314 and a protruding rib 316 extend along at least a portion of the second counter-bore 309. The caplock connector 380 comprises a coil spring 382 having one end disposed in the first counter-bore 307 and seated on the first annular edge 308 of the cap bottom 302. An opposing end of the spring 382 is disposed about a cylindrical metal head 384 and is seated on a flange 385 from which opposing tabs 386 extend. FIG. 5*e* is a sectional view of the metal head 384 comprising a bored cylinder 388 having an end portion 389 with a slot 390 and a cap 394 with a compressed coiled spring 392 disposed and retained therebetween. FIGS. 5*c* and 5*d* show the cap base 340 including a display module platform 342 and a cylindrical plug 360 having a central bore 362 with opposing channels 366 for receiving the head 384 of the caplock connector assembly 380. The display module platform 342 is comprised of a lightweight metal with a scratch resistant and corrosion resistant surface. The cylindrical plug 360 is disposed in the second counter-bore 309 of the cap bottom 302 with the caplock connector assembly 380 interposed therebetween so that the head 384 of the caplock connector assembly 380 is biased toward the display module platform 342 by the compressed spring 382. The tabs 386 prevent rotation of the head 384 in the bore 362 of the plug 360. A channel 368 extending along the plug 360 mates with the rib 316 extending along the second counter-bore 309 to ensure proper alignment of the capbase 340 with the cap bottom 302. Reinforced barbs or tabs 372 are disposed on the plug 360 frictionally engage the depressions 314 of the opposing channels 312 to secure the capbase 340 to the cap bottom 302**.

The cap base assembly 300 is releasably connectable with the switch module assembly 200 by slidably disposing the cap bottom 302 in the locking collar assembly 260 and partially into the collar 164 of module frame 140 to engage and depress the snap-action switch actuator 210 which ultimately actuates the snap-action switches 110 as discussed above. For this purpose, FIG. **5*a* shows the cap bottom 302 further comprising a plurality of ribs 318 asymmetrically disposed about the cylindrical body 304** which guide the cap base assembly 300 in corresponding channels 268 disposed about an inner circumference of the collar 262. In one embodiment, the cap bottom 302 may only be inserted into the collar 164 when the locking collar assembly 260 is rotated approximately 22 degrees relative to the collar 164 so that the radial ribs 263 are in the extended position shown in FIG. 4*e*. When the locking collar assembly 260 is in any other position relative to the collar 164, the ribs 318 of the cylindrical body 304 abut against the ridges 181 of the collar 164 thereby preventing further insertion of the cap base assembly 300 into the collar 164. The cylindrical body 304 includes opposing bevelled surfaces 320 with chapels 322 for receiving electrical contact wipers 324, interconnected by a transorb 325, which frictionally engage with the electrical contacts 172 of the collar 164. When the cap base assembly 300 is inserted into the collar 164, the guide pins 225 are extendable into corresponding bores 327 in the cylindrical body 304. The spring retaining members 221 and the opposing arms 227 of the switch actuator 210 are engagable with corresponding counter-bores and recesses 328 formed in bores 327, respectively, of the cylindrical body 304, and the locking blade 220 on the shaft 214 of the switch actuator 210 extends into the slot 390 of the cylinder 388 against the bias of spring 392. The locking collar assembly 260 however is not rotatable relative to the collar 164 when the cap base assembly 300 is inserted into the collar 164 due in part to the ribs 318 of the cylindrical body 304 abutting against the ridges 181 of the collar 164. In one embodiment, the cap base assembly 300 may be locked to the switch module assembly 200 by rotating the shaft 214 through an angle of approximately 90 degrees to engage the blade 220 between the spring 392 and the end portion 389 of the head 384 on the caplock connector assembly 380. The shaft 214 of the switch actuator 210 may be rotated by engaging the slot 217 of the shaft 214 extendable through the hole 151 of the stiffener plate 152 with a screw driver. The orientation of the shaft 214 may be determined by a viewing a "locked" and "unlocked" legend on the surface of the stiffener plate 152 that aligns the slot 217 of the shaft 214 depending whether the cap base assembly 300 is locked to the switch module assembly 200.

Figure 6A:
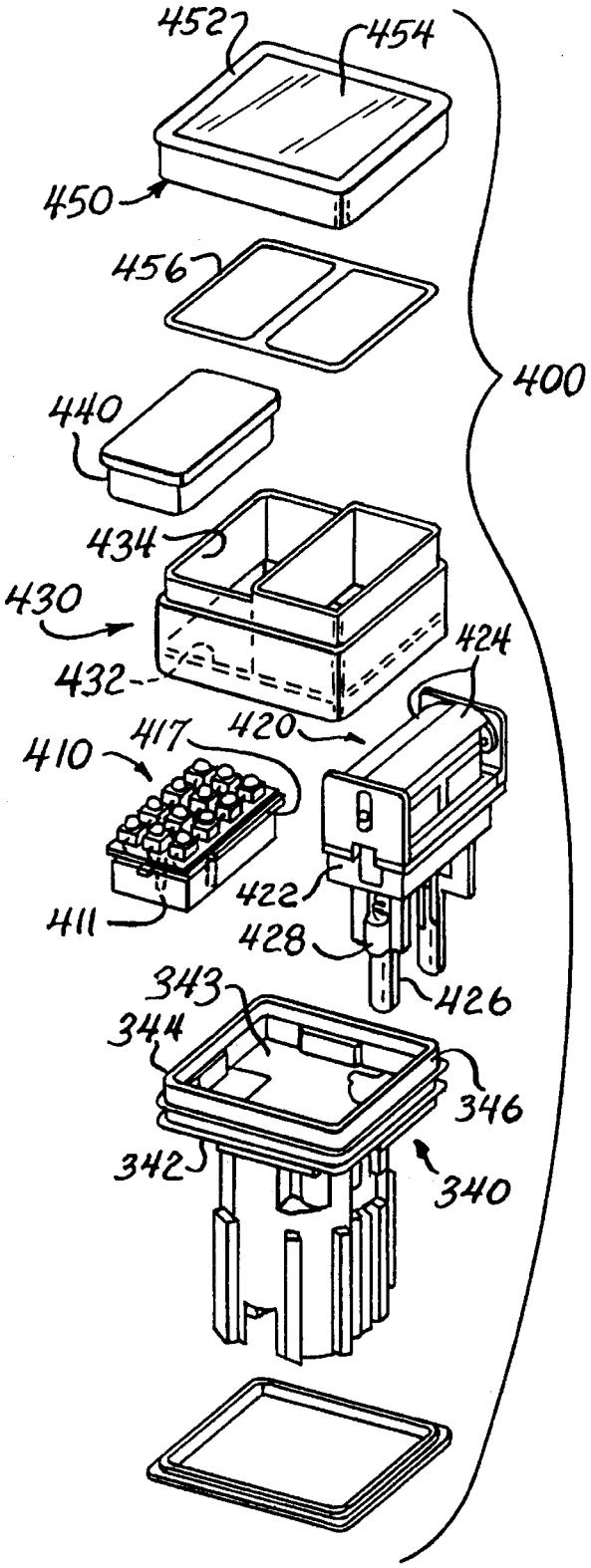
FIG. 6*a* is an exploded perspective view of a first cap module embodiment of the present invention.
Figure 6B:
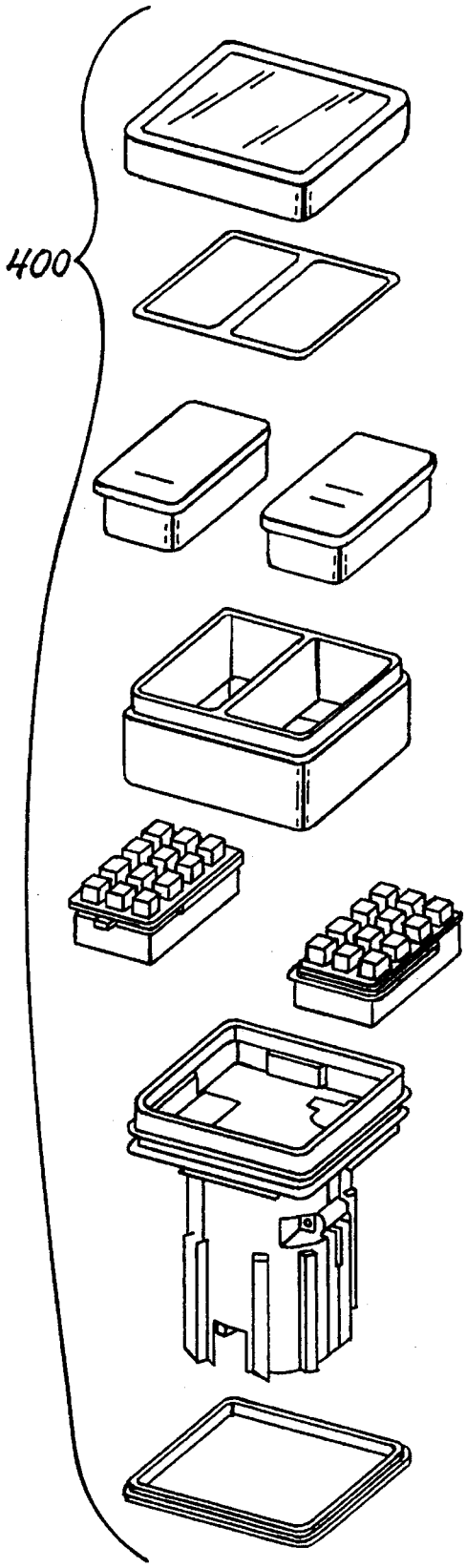
FIG. 6*b* is an exploded view of a second cap module embodiment of the present invention.
Figure 7A:
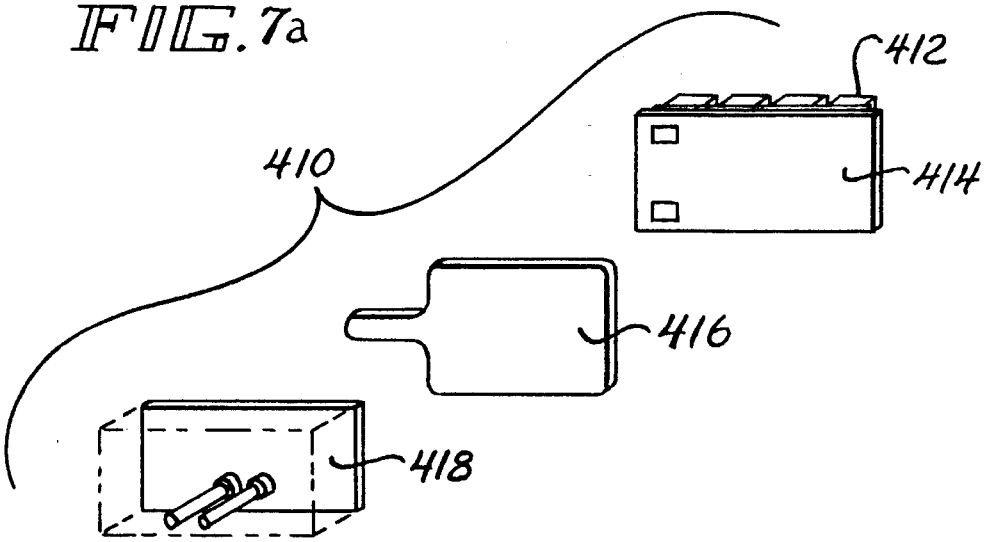
FIG. 7*a* is an exploded perspective view of an LED display assembly of the present invention.
Figure 7B:
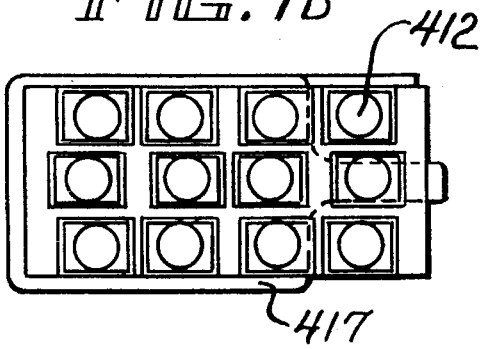
FIG. 7*b* is a front view of the LED display assembly of FIG. 7*a*.
Figure 7C:
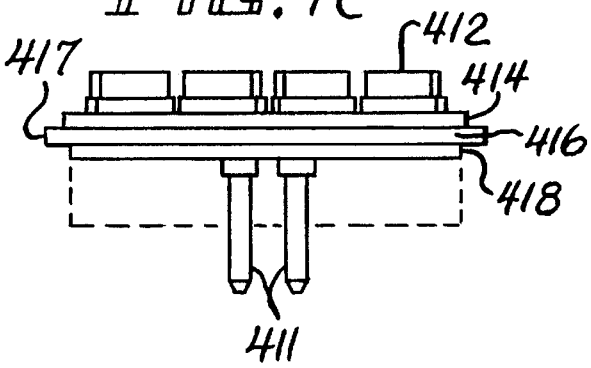
FIG. 7*c* is a side view of the LED display assembly of FIG. 7*a*.
Figure 7D:
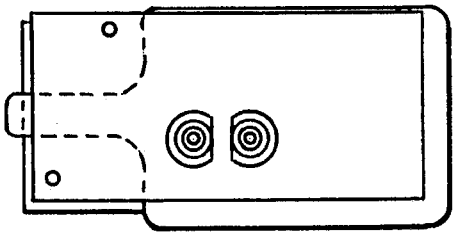
FIG. 7*d* is a sectional rear view of the LED assembly of FIG. 7*a*.

FIGS. 6*a* and 6*b* are exploded perspective views of embodiments of the cap module 400 generally comprising a display assembly mounted on the platform 342 of the capbase assembly 300 and secured thereto by a captop 430 having a bezel assembly 450 securely disposed thereon. The captop 430 is comprised of a lightweight metal with a scratch resistant and corrosion resistant surface. FIG. 6 and 7 show one embodiment of a display assembly 410 comprising a plurality of high light output LED elements 412 interconnected by a circuit to a pair of contact pins 411 and disposed on a ceramic circuit board 414 which is mounted on one side of a metal support plate 416 with an edge 417 which extends beyond the perimeter of the circuit board 414. A second ceramic circuit board 418 having electrical components forming an electrical circuit interconnecting the contact pins 411 and the LED elements 412 may be mounted on an opposing side of the plate 416. FIG. 6*a* shows the metal edge 417 of the display assembly 410 disposable on a bare metal edge 344 of the capbase 340 which in one embodiment is formed of aluminum or other highly conductive material to transfer and dissipate heat generated by the LEDs. FIG. 6*a* shows one of the electrical contact pins 411 of the display assembly 410 extendable through a hole 343 of the platform 342 to frictionally engage electrical wipers 324 which provide electrical power to the LEDs of the display assembly 410 via the contacts 172 connected to the contacts 129 of the flexible circuit board 130 as discussed above. The electrical circuitry of the flexible circuit board 130 may be configured to provide power to the LED display assembly 410 when the snap-action switches 110 are in the "on" or "off" position as required by the particular application of the switch 10. In a second embodiment shown in FIG. 6*a*, a shutter display assembly 420 comprising a bank of high light output LEDs disposed on a circuit board as discussed above is mounted on a frame 422 and covered by a cap bearing an informative legend not shown in the drawing but highly visible when the LEDs are illuminated. The frame 422 includes a pair of shutter doors 424 normally extended to close over and conceal the bank of LEDs and the cap and openable to reveal and display the informative legend on the cap upon actuating or depressing two shutter actuator stems 426 having flanges 428. FIG. 6*a* shows the frame 422 of the display assembly 420 disposable on the edge 344 of the capbase 340 and FIG. 6*a* shows the electrical contact pins 411 of the display assembly 420 extendable through a hole 343 of the platform 342 and frictionally engagable with electrical wipers 324 which provide electrical power to the LEDs of the the display assembly 420 via the contacts 172 connected to the contacts 129 of the flexible circuit board 130 as discussed above. The stems 426 and flanges 428 are extendable through a hole 344 in the platform 342 and the stems 426 extend into two of the bores 327 through the cylindrical body 304 which align and guide the stems 426 during depression of the stems 426 by the flanges 428 abutting against the collar 262 upon actuation of the switch 10. The electrical circuitry of the flexible circuit board 130 may be configured to provide power to the LEDs of the shutter display assembly 420 when shutters doors 424 are opened to reveal and display the informative legend on the cap.

The captop 430 is disposed on the platform 342 and frictionally engaged by an outer rim 346 of the capbase 340 and secured thereto, for example by an epoxy. A bare metal edge 432 is provided on an inner portion of the captop 430, which in one embodiment is comprised of aluminum, and is engagable with the edge 417 of the display assembly 410 to dissipate heat generated by the LEDs. A display cap 440 bearing an informative legend which is highly visible when illuminated by the LEDs of the display assembly 410 may be disposed in a receiving cowl 434 of the captop 430 and secured thereto, for example by epoxy. A bezel assembly 450 including a frame 452 and an anti-glare, light transparent window 454 is ultra-sonically welded to the capbase 430 which is secured about a perimeter of the captop 430 by an epoxy. The window 454 acts as a contact point for actuating the switch 10 and may be supported in part by the display caps 440. The window may be optically optimized to enhance the readability of the display in bright ambient lighting conditions and at the same time minimize optical distortion. A removable Mylar lens cover 457 may be snap fit over the window 454 to protect the lens during shipping and storage, and removed after installation of the switch. In one embodiment, the cover 457 is transparent to permit testing of the switch with the protective cover in place. A spacer 456 having a predetermined thickness may interpose the window and the captop 430 to maintain the correct optical distance between the window 454 and the display assemblies, and may also conceal any gap or seam between adjacent display caps 440. The display assemblies 410 and 420 may be disposed on the capbase 340 in a variety of alternative combinations as illustrated in the exemplary embodiment of FIG. 6*b*.

The integral unit formed by the module frame assembly 100 and the switch module assembly 200 interconnected by the blade 220 of the shaft 214 to the cap base assembly 300 and the cap module 400 is slidably disposable in the switch connector module 500 when the ribs 263 of the locking collar 260 are recessed relative to the module frame assembly 100 shown in FIGS. 4*b* and 4*c*. The locking collar 260 may be rotated relative to the collar 164 to orient the ribs 263 of the collar 260 in the recessed configuration by first withdrawing the cap bottom 302 from the locking collar assembly 260 against the bias of the spring 382, and then rotating the collar 260 relative to the collar 164. The spring 382 will then return the cap bottom 302 into the locking collar assembly 260. The integral unit is slidable into the switch connector module 500 until a prong 520 extending below a sidewall and into the switch connector module 500 engages a corresponding slot on the module frame assembly 100 and prevents further insertion of the module frame assembly 100 into the module 500. The locking collar 260 may then be rotated so that the ribs 263 extend into and engage, without protruding from, corresponding slots 510 disposed in sidewalls of the switch connector module 500 thereby locking the integral unit therein. Asymmetrically configured nut housings 530 engage the corresponding asymmetric recesses 160 and 161 of the stiffener plate 152 to properly align and guide the module frame assembly 100 into the module 500. An insulated electrical contact pin connector 550 includes a keyed stem portion 552 which is extendable into and interconnectable with the switch connector module 500 to support and align the electrical contact pins 135. The switch connector module 500 may be slidably disposed into the bracket 600, which in one embodiment is an aluminum or other lightweight metal bracket, and securely retained therein by one or more screws 610 extendable through flanges 620 and threadably engagably with nuts 532 retained in the nut housings 530 of the module 500. FIGS. 1 and 2 show a switch protector hood 560 having a light transparent shield 562 with side walls 563 hinged along an edge to a frame 564 which may be disposed about the switch connector module 500 and securely clamped between a flange 535 of the module 500 and an edge 619 of the bracket. The shield 562 is biased in a closed position over the window 454 of the switch 10 by a spring not shown in the drawing, although the shield 562 may be pivoted about the hinge to gain access to and actuate the switch 10.

The foregoing is a description enabling one of ordinary skill in the art to make and use the preferred embodiments of the present invention. It will be appreciated by those skilled in the art that there exists variations, modifications and equivalents to the embodiments disclosed herein. The present invention therefore is to be limited only by the scope of the appended claims.

What is claimed is:

1. An electrical switch assembly for alternate on and off switch operation, the electrical switch assembly comprising:

an electrical switch having a pair of normally open electrical contacts and a pair of normally closed electrical contacts, wherein the electrical switch may be actuated to close the normally open electrical contacts and open the normally closed electrical contacts, the electrical contacts of the switch connected to electrical contact pins matable with a contact pin connector;

a module frame assembly having a channel with a latch spring hook, a cavity for receiving the electrical switch, and a ribbed collar pivotally connected thereto;

a switch actuator assembly disposed on a shaft for engaging and actuating the electrical switch upon depressing the shaft;

a cap base assembly is releasably connected to the shaft of the switch actuator assembly and disposable in the ribbed collar for depressing the shaft to actuate the electrical switch, the cap base assembly including a cap module having an LED illuminatable display for indicating switch status, wherein the cap base assembly further comprises a metal cap base platform having an edge, the LED illuminatable display having an LED disposed on a metal base having an outer edge that is mountable on the edge of the cap base platform, the cap module being formed of a metal and having an inner edge for engaging the outer edge of the LED metal base when the metal cap module is disposed on the cap base platform, wherein the metal base transfers heat from the LED to the metal cap module and the metal cap base platform which act as a heat sink for the LED;

an electrical circuit interconnectable to the LED illuminatable display and electrical contacts for providing electrical power to the LED illuminatable display;

a latch spring guide disposed on the shaft and reciprocatingly receivable in the channel of the module frame assembly, the latch spring guide having a hook channel for receiving and guiding the latch spring hook when the shaft and the latch spring guide are moved into and out of the channel of the module frame assembly, the latch spring guide having a first and a second edge disposed in the hook channel thereof for engaging the latch spring hook in order to retain the latch spring guide in the channel and maintain the switch actuator assembly in engagement with the actuated electrical switch so as to latch the actuated electrical switch, the latch spring guide having a ramp disposed in the channel of the latch spring guide and extending away from the first edge for guiding and disengaging the latch spring hook from the first edge to permit the shaft and the latch spring guide to move out of the channel of the module frame assembly and disengage the switch actuator assembly from the electrical switch to unlatch and de-actuate the electrical switch, wherein the electrical switch is comprised of a plurality of snap-action electrical switches interconnected by a flexible circuit board, the snap-action electrical switches disposable in cavities of the module frame assembly, the switch actuator assembly actuating the snap-action electrical switches upon depressing the cap module of the cap base assembly, the electrical switch assembly emitting audible and tactile indicators perceptible to an operator of the switch when the latch spring hook engages the first edge to indicate that the electrical switch has been actuated and latched, and when the latch spring hook moves over the second edge to indicate that the electrical switch has been unlatched and de-actuated.

2. The electrical switch of claim 1 wherein the capbase assembly further comprises a metal capbase platform having an edge, the LED illuminatable display having an LED disposed on a metal base having an outer edge that is mountable on the edge of the capbase platform, the cap module being formed of a metal and having an inner edge for engaging the outer edge of the LED metal base when the metal cap module is disposed on the capbase platform, wherein the metal base transfers heat from the LED to the metal cap module and the metal capbase platform which act as a heat sink for the LED.

3. The electrical switch assembly of claim 2 further comprising:

a switch connector module having a slot in a side wall thereof, the module frame assembly, ribbed collar and the cap base assembly interlockably receivable in the switch connector module by pivoting the ribbed collar relative to the module frame assembly to engage a rib of the ribbed collar with the slot of the switch connector module;

an electrical contact pin connector connectable to the switch connector module for receiving and aligning the electrical contact pins of the electrical switch; and a bracket for receiving and retaining the switch connector module and the electrical contact pin connector.

4. The electrical switch of claim 3 further comprising a tab disposed on the ribbed collar and engagable with the module frame assembly, wherein the ribbed collar is pivotable through an angle of approximately 22 degrees relative to the module frame assembly and the tab engages the module frame assembly when the rib of the ribbed collar engages the slot of the switch connector module.

5. The electrical switch of claim 4 further comprising a spring disposed between the switch actuator and the module frame assembly for biasing the switch actuator away from the electrical switch when the latch spring hook is disengaged from the first edge of the latch spring guide.

6. An electrical switch assembly for momentary operation, the electrical switch assembly comprising:

an electrical switch having a pair of normally open electrical contacts and a pair of normally closed electrical contacts, wherein the electrical switch may be actuated to close the normally open electrical contacts and open the normally closed electrical contracts, the electrical contacts of the switch connected to electrical contactpins matable with a contact pin connector;

a module frame assembly having a channel with a latch spring hook, a cavity for receiving the electrical switch and a ribbed collar pivotally connected thereto;

a switch actuator assembly disposed on a shaft for engaging and actuating the electrical switch upon depressing the shaft;

a cap base assembly releasably connectable to the shaft of the switch actuator assembly and disposable in the ribbed collar for depressing the shaft to actuate the electrical switch, the cap base assembly including a cap module having an LED illuminatable display for indicating switch status;

an electrical circuit interconnectable to the LED illuminatable display and the electrical contacts for providing electrical power to the LED illuminatable display;

a latch spring guide disposed on the shaft and reciprocatingly receivable in the channel of the module frame assembly, the latch spring guide having a hook channel for receiving and guiding the latch spring hook when the shaft and the latch spring guide are moved into and out of the channel of the module frame assembly, said hook channel comprised of a first edge and a second edge wherein the electrical switch assembly emits audio and tactile indicators perceptible to an operator of the switch when the latch spring hook moves over the first edge to indicate that the electrical switch has been actuated and when the latch spring hook moves over the second edge to indicate that the electrical switch has been de-actuated, wherein the switch actuator assembly engages and actuates the electrical switch when the shaft and the spring latch are moved into the channel of the module frame assembly and the switch actuator assembly disengaging and de-actuating the electrical switch when the shaft and latch spring guide are moved out of the channel of the module frame assembly, wherein the electrical switch comprises a plurality of snap-action electrical switches interconnected by a flexible circuit board, the snap-action electrical switches disposable in cavities of the module frame assembly, the switch actuator assembly actuating the snap-action electrical switches upon depressing the cap module of the cap base assembly.

7. The electrical switch of claim 6 wherein the capbase assembly further comprises a metal capbase platform having an edge, the LED illuminatable display having an LED disposed on a metal base having an outer edge that is mountable on the edge of the capbase platform, the cap module being formed of a metal and having an inner edge for engaging the outer edge of the LED metal base when the metal cap module is disposed on the capbase platform, wherein the metal base transfers heat from the LED to the metal cap module and the metal capbase platform which act as a heat sink for the LED.

8. The electrical switch assembly of claim 7, further comprising:

a switch connector module having a slot in a side wall thereof, the module frame assembly, ribbed collar and the cap base assembly interlockably receivable in the switch connector module by pivoting the ribbed collar relative to the module frame assembly to engage a rib of the ribbed collar with the slot of the switch connector module;

an electrical contact pin connector connectable to the switch connector module for receiving and aligning the electrical contact pins of the electrical switch; and a bracket for receiving and retaining the switch connector module and the electrical contact pin connector.

9. The electrical switch of claim 8 further comprising a tab disposed on the ribbed collar and engagable with the module frame assembly, wherein the ribbed collar is pivotable through an angle of approximately 22 degrees relative to the module frame assembly and the tab engages the module frame assembly when the rib of the ribbed collar engages the slot of the switch connector module.

10. The electrical switch of claim 9 further comprising a spring disposed between the switch actuator and the module frame assembly for biasing the switch actuator away from the electrical switch when the latch spring hook is disengaged from the first edge of the latch spring guide.

11. A method for operating an electrical switch assembly in an alternate on and off switch mode, the electrical switch assembly having an electric switch with a pair of normally open electrical contacts and a pair of normally closed electrical contacts, wherein the electrical switch may be actuated to close the normally open electrical contacts and open the normally closed electrical contacts, the electrical contacts of the switch connected to electrical contact pins matable with a contact pin connector, a module frame assembly having a channel with a latch spring hook and a cavity for receiving the electrical switch, and a switch actuator assembly and a latch spring guide disposed on a shaft for engaging and actuating the electrical switch upon depressing the shaft, the method comprising the steps of:

moving the shaft and the latch spring guide into the channel of the module frame assembly;

engaging the electric switch with the switch actuator assembly to actuate the electric switch, wherein a cap base assembly is releasably connected to the switch actuator assembly, the cap base assembly having a metal cap base platform with an edge for receiving an outer edge of a metal base on which an LED is disposed, the metal cap base platform serving as a heat sink for the LED to receive transferred heat from the LED, and a metal cap module having an inner edge for engaging the outer edge of the metal base when the metal cap module is disposed on the cap base platform;

receiving and guiding the latch spring hook of the module frame assembly in a hook channel of the latch spring guide when the shaft and the latch spring guide are moved into the channel of the module frame assembly, said hook channel comprised of a first and second edge, wherein an audio and tactile indicators perceptible are emitted to an operator of the switch when the latch spring hook engages the first edge to indicate that the electrical switch has been actuated and latched and emitting audio and tactile indicators perceptible to an operator of the switch when the latch spring hook moves over the second edge to indicate that the electrical switch has been unlatched and de-actuated;

engaging and retaining the latch spring hook on a first edge disposed in the channel of the latch spring guide to retain the latch spring guide in the channel and maintain the switch actuator assembly in engagement with the actuated electrical switch to latch the actuated electrical switch; and disengaging the latch spring hook from the edge to permit the shaft and the latch spring guide to move out of the channel of the module frame assembly and disengage the switch actuator assembly from the electrical switch to unlatch and de-actuate the electrical switch.

12. The method of claim 11 wherein the channel of the latch spring guide further comprises a second edge disposed in the channel of the latch spring guide, the method further comprising the steps of emitting audio and tactile indicators perceptible to an operator of the switch when the latch spring hook engages the first edge to indicate that the electrical switch has been actuated and latched and emitting audio and tactile indicators perceptible to an operator of the switch when the latch spring hook moves over the second edge to indicate that the electrical switch has been unlatched and de-actuated.

13. A method for operating an electrical switch assembly in a momentary on and off switch mode, the electrical switch assembly having an electric switch with a pair of normally open electrical contacts and a pair of normally closed electrical contacts, wherein the electrical switch may be actuated to close the normally open electrical contacts and open the normally closed electrical contacts, the electrical contacts of the switch connected to electrical contact pins matable with a contact pin connector, a module frame assembly having a channel with a latch spring hook and a cavity for receiving the electrical switch, and a switch actuator assembly and a latch spring guide disposed on a shaft for engaging and actuating the electrical switch upon depressing the shaft, the method comprising the steps of:

moving the shaft and the latch spring guide into and out of the channel of the module frame assembly;

engaging the electrical switch with the switch actuator assembly to actuate the electric switch when the shaft and the latch spring guide are moved into the channel of the module frame assembly, wherein a cap base assembly is releasably connected to the switch actuator assembly, the cap base assembly having a metal cap base platform with an edge for receiving an outer edge of a metal base on which an LED is disposed, and a metal cap module having an inner edge for engaging the outer edge of the metal base when the metal cap module is disposed on the cap base platform, the method comprising a further step of transferring heat from the LED to the metal cap module and the metal cap base platform which serve as a heat sink for the LED;

receiving and guiding the latch spring hook of the module frame assembly in a hook channel of the latch spring guide when the shaft and the latch spring guide are moved into and out of the channel of the module frame assembly, said hook channel comprising a first and a second edge and then emitting audio and tactile indicators perceptible to an operator of the switch when the latch spring hook moves over the first edge to indicate that the electrical switch has been actuated and emitting audio and tactile indicators perceptible to an operator of the switch when the latch spring hook moves over the second edge to indicate that the electrical switch has been de-actuated; and disengaging the switch actuator assembly from the electrical switch to de-actuate the electrical switch.

14. The method of claim 13 wherein the channel of the latch spring guide further comprises a first and a second edge disposed in the channel of the latch spring guide, the method further comprising steps of emitting audio and tactile indicators perceptible to an operator of the switch when the latch spring hook moves over the first edge to indicate that the electrical switch has been actuated and emitting audio and tactile indicators perceptible to an operator of the switch when the latch spring hook moves over the second edge to indicate that the electrical switch has been de-actuated.

* * * * *